United States Patent [19]

Uematsu et al.

[11] Patent Number: 4,612,128

[45] Date of Patent: Sep. 16, 1986

[54] LUBRICANT FOR PLASTIC WORKING OF METALS

[75] Inventors: Takao Uematsu; Hiroshi Suzuki, both of Hitachi; Shigeki Komatsuzaki, Mito; Fumio Nakano, Hitachi, all of Japan

[73] Assignee: Hitachi, Ltd., Tokyo, Japan

[21] Appl. No.: 782,899

[22] Filed: Oct. 2, 1985

[30] Foreign Application Priority Data

Oct. 3, 1984 [JP] Japan ..... 59-206333
Oct. 11, 1984 [JP] Japan ..... 59-211337

[51] Int. Cl.[4] ..... C10M 137/04

[52] U.S. Cl. ..... 252/32.5; 252/49.8; 72/42

[58] Field of Search ..... 252/32.5, 49.8; 72/42

[56] References Cited

U.S. PATENT DOCUMENTS

| | | | |
|---|---|---|---|
| 3,281,381 | 10/1966 | Hechenblerkner et al. | 252/49.8 |
| 3,484,375 | 12/1969 | Hau | 252/49.8 |
| 3,933,658 | 1/1976 | Beiswanger et al. | 252/32.5 |
| 4,215,002 | 7/1980 | Fein | 252/32.5 |

*Primary Examiner*—Jacqueline V. Howard
*Attorney, Agent, or Firm*—Antonelli, Terry & Wands

[57] ABSTRACT

A lubricating composition comprising (a) a lubricating oil, (b) at least one phosphite ester of pentaerythritol, and (c) at least one compound selected from phosphate monoesters and diesters and phosphonates is suitable for metal forming, particularly for plastic working of aluminum and aluminum alloy with excellent formability and heat resistance.

24 Claims, 1 Drawing Figure

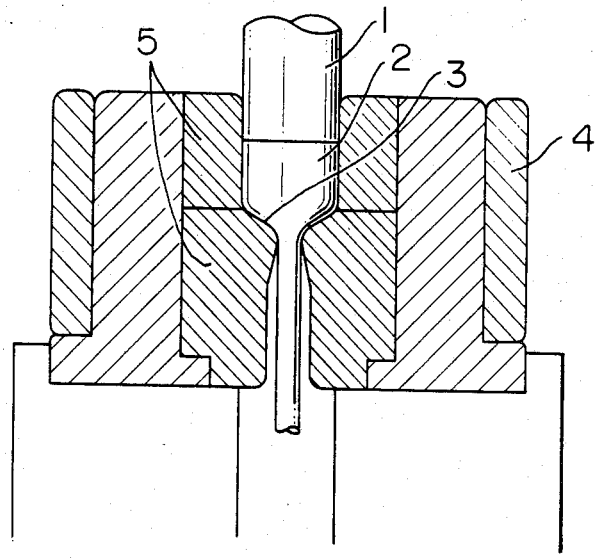
1
2
3
4
5

LUBRICANT FOR PLASTIC WORKING OF METALS

BACKGROUND OF THE INVENTION

This invention relates to a lubricating composition suitable for metal forming (or working) such as plastic working, e.g., cold forging, of metals, particularly of aluminum and alloys thereof and a process for forming the metal using such a lubricating composition.

Aluminum and alloys thereof are light-weight and have good appearance and quality, so that they are widely used as sash door and window frames, cans, domestic appliance parts, and the like. These parts are almost made by plastic working with high productivity. Processes for plastic working change depending on structure, reduction of area, etc., of parts, but considering economic merit, cold forging is going to be employed mainly. Generally speaking, in the case of parts made of aluminum or an alloy thereof, since demands for surface state (gloss) due to serious consideration of appearance and dimensional accuracy are high, a special lubricant is used for the working, unlike a lubricant for plastic working of steel stock. Heretofore, in the cold forging of aluminum or an alloy thereof, there have been used lubricants comprising a mineral oil as a base oil, an oilness agent such as a fatty acid, a fatty acid ester, a higher alcohol, or the like, and an extreme-pressure additive such as tricresyl phosphite, trilauryl phosphite, or the like or a solid lubricant such as graphite, molybdenum disulfide, or the like. These compositions of lubricants are considered mainly so as to give good surface state after the working. Thus, these lubricants are only suitable for working with a small deformation amount and low in reduction of area. In the case of making formed articles with high reduction of area causing high temperatures and high surface pressures or with complicated shapes, since these lubricants are insufficient in resistance to load and heat resistance, they are limited in their applications due to the generation of cracks, surface roughening, deformed parts caused by non-uniform plastic flow, galling (or seizure), and the like.

In order to improve galling (or seizure) resistance which is one of important properties of lubricants for working (or forming), there is employed a process wherein the amount of oil to be taken into friction surfaces of a mold and a workpiece is increased at the time of working. That is, the improvement of wettable properties and affinity of the lubricant to a workpiece is aimed at. For example, there is proposed a lubricant for aluminum working comprising one or more mono- or di-phosphate esters of a polyoxyalkylene alkyl ether or polyoxyalkylene alkylphenyl ether, one or more $C_{12}$-18 saturated or unsaturated fatty acid esters or higher alcohols, one or more metal soaps, and a mineral oil (Japanese Patent Unexamined Publication No. 38797/83}, or a lubricant comprising a mineral oil, a polyoxyalkylene derivative, either alone or a mixture of a partial ester of higher carboxylic acid with a polyhydric alcohol and a higher alcohol, and a phosphur compound (Japanese Patent Unexamined Publication No. 26997/81). But, even these lubricants have problems of easily bringing about worsening of surface state, galling, cracks and the like in the case of high reduction of area being required or of forming shaped article parts having complicated shapes.

On the other hand, there is proposed a process for working a metal piece comprising pre-treating the surface of a workpiece with a chemical film, followed by subjecting to working after coating a metal soap on the surface. According to this process, good performance is exhibited without causing galling even in the case of high reduction of area being required, but surface appearance is poor due to, for example, coloring of the surface with the treating agent, which results in making it necessary to conduct finish working by mechanical working, or the like. Therefore, this process cannot be said as a general purpose lubricating process. Further, this process has disadvantages in that complicated steps are necessary for lubricating treatment, and control of the treating solutions is necessary.

SUMMARY OF THE INVENTION

This invention provides a lubricating composition overcoming the disadvantages of the prior art and suitable for metal forming such as plastic forming of aluminum or an alloy thereof with simplified steps for giving formed articles with improved quality, even in cold forging wherein high reduction of area is required or in forming of articles with complicated shapes.

This invention also provides a process for plastic forming a metallic workpiece using such a lubricating composition with simplified steps.

This invention provides a lubricating composition suitable for metal forming comprising (a) a lubricating oil, (b) at least one phosphite ester of pentaerythritol, and (c) at least one compound selected from the group consisting of phosphate monoesters, phosphate diesters and phosphonates.

This invention also provides a process for plastic forming a metallic workpiece which comprises coating a lubricating composition suitable for metal forming comprising (a) a lubricating oil, (b) at least one phosphite ester of pentaerythritol, and (c) at least one compound selected from the group consisting of phosphate monoesters, phosphate diesters and phosphonates on a surface of a metallic workpiece, and conducting plastic forming of the metallic workpiece in the presence of a film formed by the lubricating composition.

BRIEF DESCRIPTION OF THE DRAWING

The attached drawing is a vertical cross-sectional view of a forward extrusion die used for evaluation of properties o lubricants.

DESCRIPTION OF THE PREFERRED EMBODIMENTS

The lubricating composition of this invention comprises (a) a lubricating oil, (b) at least one phosphite ester of pentaerythritol, and (c) at least one compound selected from the group consisting of monophosphate esters, diphosphate esters and phosphonates.

As the component (a), the lubricating oil, there can be used conventionally used mineral oils, synthetic oils such as polymerized olefins (α-olefins), monoesters, diesters, polyol esters, polybutene, polyalkylene glycols, and a mixture thereof. Properties of the lubricating oil can be selected properly depending on working conditions and operational conditions. It is preferable to use a lubricating oil having a viscosity of 10 $mm^2$/sec (cSt) or more measured at 40° C. (JIS K-2283).

As the component (b), there can be used at least one phosphite ester of pentaerythritol represented by the formula:

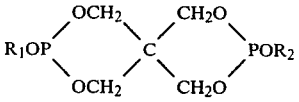

(I)

wherein $R_1$ is an alkyl group preferably having 8 to 18 carbon atoms, or an alkylphenyl group in which the alkyl moiety preferably has 8 to 9 carbon atoms; and $R_2$ is an alkyl group preferably having 8 to 18 carbon atoms, an alkylphenyl group in which the alkyl moiety preferably has 8 to 9 carbon atoms, or hydrogen.

Concrete examples of $R_1$ and $R_2$ are an octyl group, an isodecyl group, a lauryl group, a tridecyl group, a palmityl group, a stearyl group, a nonylphenyl group, an octylphenyl group, and the like.

As the component (c), there can be used at least one compound selected from the group consisting of phosphate monoesters, phosphate diesters and phosphonates. The phosphate monoesters and phosphate diesters can be represented by the formulae:

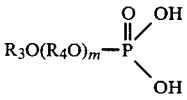

(II)

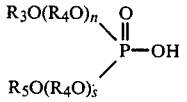

(III)

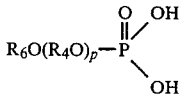

(IV)

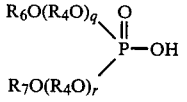

(V)

wherein $R_3$ and $R_5$ are independently an alkyl group; $R_4O$ is an ethylene oxide group, a propylene oxide group, or a butylene oxide group; $R_6$ and $R_7$ are independently an alkylphenyl group in which the alkyl moiety has preferably 8 to 9 carbon atoms; m and p are independently an integer of preferably 2 to 15 and $(n+s)/2$ and $(q+r)/2$ are independently an integer of preferably 2 to 15. Concrete examples of the alkyl group ($R_3$, $R_5$) are methyl, ethyl, butyl, and the like groups as well as octyl, isodecyl, lauryl, tridecyl, palmityl, stearyl and oleyl groups. A preferable carbon number of the alkyl group is 8 (octyl) to 18 (stearyl and oleyl). Concrete examples of the alkylphenyl group ($R_6$, $R_7$) are nonylphenyl and octylphenyl groups.

The phosphonates can be represented by the formula:

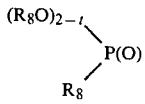

(VI)

wherein $R_8$ is an alkyl group preferably having 4 to 18 carbon atoms, more preferably 4 to 8 carbon atoms; and t is zero or an iteger of 1.

Preferable examples of the alkyl group are a butyl group, an octyl group, etc. The phosphonates of the formula (VI) can be phosphonate monoesters or phosphonate diesters, or a mixture thereof.

The lubricating composition of this invention preferably contains the component (a) in an amount of 98 to 40% by weight and a total of the components (b) and (c) in an amount of 2 to 60% by weight, the ratio of the components (c)/(b) being preferably 5/95 to 95/5.

The component (b) seems to have functions of improving lubricating properties of a film formed, lowering a forming load, improving heat resistance and preventing galling even for products with high reduction of area. The component (c) seems to have functions of improving the supply of a lubricating oil to a friction surface and forming a lubricating film excellent in lubricating properties on a surface of metallic workpiece by deformation heat and frictional heat at the time of working.

Therefore, when the total amount of the components (b) and (c) is too low or individual amounts thereof are too low, a tough lubricating film cannot be formed on the surface of metallic workpiece and thus galling takes place.

On the other hand, even if the amounts of the components (b) and (c) are too much, further improvement cannot be expected.

When at least one phosphonate of the formula (VI) is used as the component (c), it is preferable to use the component (a) in an amount of 95 to 40% by weight, the component (b) in an amount of 2 to 25% by weight and the component (c) in an amount of 3 to 35% by weight.

The lubricating composition of this invention may contain one or more solid lubricants such as graphite, molybdenum disulfide, tungsten disulfide, boron nitride, carbon fluoride, polytetrafluoroethylene, etc., extreme-pressure additives such as organic chlorine and sulfur compounds, and the like conventional additives so long a these additives do not reduce the effects of the composition of this invention.

The lubricating composition of this invention can be applied to plastic forming of metals, particularly aluminum and alloys thereof, such as deep drawing, drawing, wire drawing, rolling, ironing, extrusion, and the like by cold working. More concretely, the lubricating composition of this invention is coated on a surface of a metallic workpiece by a conventional coating method such as brushing, dipping (dipping a heated workpiece in a lubricating composition or dipping a workpiece in a heated lubricating composition), roll coating, spraying, or the like, and the plastic forming (or working) of the metallic workpiece is conducted in the presence of a film which has been formed by the reaction of the metallic workpiece and the components (b) and (c).

The lubricating composition of this invention is excellent in coating properties.

By using the lubricating composition of this invention, even the working of articles having high reduction of area and complicated shapes can be conducted at one time and the surface finishing of articles formed is very good.

As the metallic workpiece, it is preferable to use pure aluminum, aluminum and aluminum alloys defined by JIS H4040, and the like.

The materials of molds or dies used for forming the metal are not particularly limited. There can be used tool steel alloy and tool steel alloy with rigid treatment as the material for molds and dies so as to produce good formed (or worked) products.

This invention is illustrated by way of the following Examples, in which all percents are by weight unless otherwise specified.

EXAMPLES 1 to 10, COMPARATIVE EXAMPLES 1 and 2

Lubricating compositions having compositions as listed in Table 1 were prepared. Each lubricating composition was coated on a metallic workpiece made of aluminum alloy. Then, the workpiece was subjected to cold working by a forward extrusion method under the conditions mentioned below to examine formability, surface state after forming, and dimensional accuracy. The results are shown in Table 1. 1. FORMING CONDITIONS caused by lack of lubricating properties of a lubricating composition.

3. FORMABILITY

A forward extrusion die as shown in the attached drawing was used. In the drawing, numeral 1 denotes a punch, numeral 2 a metallic workpiece, numeral 3 a surface to be formed, numeral 4 a band heater for heating the die, and numeral 5 die material made of SDK11.

The formability was evaluated as follows. A die temperature was raised stagewise by 5° to 20° C. for each stage by the band heater 4. At each temperature level, 10 workpieces coated with a lubricating composition were subjected to plastic forming at a rate of 15 mm/sec. After forming, generation of galling was examined. The formability was defined by the highest die temperature which does not generate galling on the surface of workpieces. The higher the temperature, more excellent in heat resistance as to a lubricating film formed on the surface of workpiece at the time of forming, that is, more excellent in formability of a lubricating composition.

As is clear from Table 1, the lubricating compositions of this invention give good gloss on the surfaces of workpieces after formation and remarkably excellent dimensional accuracy and formability compared with Comparative Examples 1 and 2.

TABLE 1

| | Comparative Example | | Example | | | | | | | | | |
|---|---|---|---|---|---|---|---|---|---|---|---|---|
| Example No. | 1 | 2 | 1 | 2 | 3 | 4 | 5 | 6 | 7 | 8 | 9 | 10 |
| Component (b) (%) | | | | | | | | | | | | |
| Ditridecylpentaerythritol diphosphite | | | 1.5 | 2 | | | 25 | | | 10 | 5 | |
| Distearylpentaerythritol diphosphite | 10 | | | | 2 | | | 10 | | | | 10 |
| Dinonylphenylpentaerythritol diphosphite | | | | | | 5 | | | 10 | | 5 | |
| Component (c) (%) | | | | | | | | | | | | |
| Dibutyl butylphosphonate | | | | | 3 | | 35 | | | 10 | 10 | |
| Dioctyl octylphosphonate | | 10 | 2 | 3 | | | | 10 | | | | 5 |
| Octyl phosphonate monooctyl ester | | | | | | 5 | | | 10 | | 10 | 10 |
| Component (a) (%) | | | | | | | | | | | | |
| Mineral oil | 90 | | 96.5 | 95 | 95 | 90 | 40 | | | | 50 | |
| Dioctyl sebacate | | 90 | | | | | | 80 | | | | 50 |
| Trimethylolpropane tricaprilate | | | | | | | | | 80 | | 20 | |
| Polybutene | | | | | | | | | | 80 | | 25 |
| Total of the composition (%) | 100 | 100 | 100 | 100 | 100 | 100 | 100 | 100 | 100 | 100 | 100 | 100 |
| Properties of formed article | | | | | | | | | | | | |
| Surface state* | Δ | Δ | Δ~○ | ○ | ○ | ◎ | ◎ | ◎ | ◎ | ◎ | ◎ | ◎ |
| Dimensional accuracy (mm) | 0.15 | 0.13 | 0.07 | 0.04 | 0.04 | 0.02 | 0.02 | 0.03 | 0.02 | | | |
| Formability (°C.) | 105 | 115 | 130 | 160 | 155 | 190 | 250 | 255 | 260 | 240 | 245 | 250 |

(Note)
* Remarkably good (high gloss)
○ Good
Δ Bad (with peeling and cracks)

(1) Metallic workpiece

Material: aluminum alloy (JIS A5056)
Size: outer diameter 9.9 mm, length 30 mm, max. surface roughness 1.8 μm.

(2) Die and Sizes of Major Parts

Material: SDKll (tool steel, JIS G4404)
Container diameter: 10 mm
Extrusion angle: 120°
Drawing diameter: 6 mm (reduction of area: 64%)

2. Dimensional Accuracy

Dimensional accuracy was evaluated by an average value of 10 workpieces of difference in diameters measured at 5 mm and 50 mm from the top of drawing after forming. When the dimensional accuracy is 1.0 or more, cracks were generated at the top portion. This was

EXAMPLES 11 to 23, COMPARATIVE EXAMPLES 3 to 6

Lubricating compositions having compositions as listed in Table 2 were prepared. Using these lubricating compositions, the formability, the surface state after forming, and the dimensional accuracy in the same manner as described in Example 1 and a forming load as explained below were examined under the same conditions as described in Example 1 except for using as metallic workpiece having a maximum surface roughness of 2.1 μm.

FORMING LOAD

A pressure transducer was attached to a pressing piping of a hydraulic press and a pressure at the time of forming was recorded by a recorder. The extrusion pressure at the time of forming is greatly influenced by lubricating properties of a lubricating film (a friction coefficient) formed on a friction surface. The larger the friction coefficient becomes, the larger the extrusion pressure at the time of forming becomes. The forming load was evaluated by a pressure (or load) at the maximum die temperature generating no galling on a surface of a workpiece after the formation.

The results are shown in Table 3.

TABLE 2

| Component | Name | Comparative Example 3 | 4 | 5 | 6 | Example 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|
| (c) (%) | Polyoxyethyleneoctyl ether phosphate monoester* | 10 | | | | 0.1 | 1 | 1.9 | | | | | | | | | | |
| | Polyoxyethyleneoleyl ether phosphate mono- & di-esters** | | 10 | | | | | | 5 | 10 | | | | | | | | |
| | Polyoxyethylenelauryl ether phosphate monoester** | | | | | | | | | | | | 8 | | | 28 | | |
| | Polyoxyethylenetridecyl ether phosphate monoester** | | | | | | | | | | | | 12 | | | | | 6 |
| | Polyoxyethylenestearyl ether phosphate monoester** | | | | | | | | | | | | | 12 | 12 | | | |
| | Polyoxyethylenenonylphenyl ether phosphate mono- & di-esters** | | | | | | | | | | 0.25 | 9.5 | | | | | | |
| | Polyoxyethylenenonyl octylphenyl ether phosphate mono- & di-esters** | | | | | | | | | | | | | 18 | | | 54 | |
| (b) (%) | Dioctylpentaerythritol diphosphite | | | 2 | | 1.9 | 1 | 0.1 | | | | | | | | | 6 | |
| | Dilaurylpentaerythritol diphosphite | | | | | | | | 5 | | | | | 30 | | | | |
| | Ditridecylpentaerythritol diphosphite | | | | | | | | | | | | 20 | | | 7 | | |
| | Distearylpentaerythritol diphosphite | | | | 2 | | | | | | 4.75 | 0.5 | | | | | | 9 |
| | Dinonylphenylpentaerythritol diphosphite | | | | | | | | | 10 | | | | | 3 | | | |
| (a) (%) | Mineral oil ($\eta$ = 30 mm$^2$/sec, 40° C.) | 90 | | 98 | | 98 | | | | | | 50 | | | 60 | | 40 | |
| | Poly($\alpha$-olefin) ($\eta$ = 52 mm$^2$/sec) | | | | | | | | 90 | | | | 60 | | | | | 85 |
| | Diester ($\eta$ = 13 mm$^2$/sec) | | | | | | 98 | | | | | | | | 25 | 15 | | |
| | Polyol ester ($\eta$ = 26 mm$^2$/sec) | | 90 | | 98 | | | | | | | 40 | | | | | | |
| | Polybutene ($\eta$ = 25 mm$^2$/sec) | | | | | | | 98 | | | 95 | | | | | 50 | | |
| | Polyalkylene glycol ($\eta$ = 56 mm$^2$/sec) | | | | | | | | | 80 | | | | 40 | | | | |

TABLE 3

| Example No. | Dimensional accuracy (mm) | Surface state | Formability (°C.) | Maximum forming load (kgf) |
|---|---|---|---|---|
| Comparative Example | | | | |
| 3 | 0.110 | Δ | 105 | 7070 |
| 4 | 0.095 | Δ | 110 | 6890 |
| 5 | 0.057 | ○ | 100 | 6670 |
| 6 | 0.048 | ○ | 155 | 6750 |
| Example | | | | |
| 11 | 0.048 | ○~◎ | 180 | 6180 |
| 12 | 0.037 | ◎ | 185 | 5970 |
| 13 | 0.066 | ◎ | 180 | 6360 |
| 14 | 0.028 | ◎ | 230 | 6490 |
| 15 | 0.025 | ◎ | 250 | 5530 |
| 16 | 0.025 | ◎ | 250 | 6620 |
| 17 | 0.030 | ◎ | 280 | 6030 |
| 18 | 0.027 | ◎ | 275 | 6140 |
| 19 | 0.026 | ◎ | 280 | 5600 |
| 20 | 0.030 | ◎ | 280 | 5850 |
| 21 | 0.030 | ◎ | 290 | 5960 |
| 22 | 0.027 | ◎ | 260 | 6050 |
| 23 | 0.025 | ◎ | 270 | 6150 |

As is clear from the results in Table 3, the lubricating compositions of this invention give good results improved remarkably in heat resistance and lubricating properties of the lubricating films formed at the time of forming even under very severe conditions with large reduction of area. Further, there is produced no cracks at the top portion of the workpieces after the forming, and the dimensional accuracy and the surface state are remarkably excellent.

As is clear from the above-mentioned Examples, the lubricating compositions of this invention can form lubricating films having excellent heat resistance on friction surfaces by the heat generated at the time of forming by only coating the lubricating compositions on metallic workpieces, so that it is possible to subject parts having large reduction of area or complicated shapes to plastic working unlike known lubricants for metal forming. Therefore, this invention greatly contributes to the simplification of the metal forming steps and cost-cutting of the process.

What is claimed is:

1. A lubricating composition suitable for metal forming comprising:

(a) a lubricating oil, (b) at least one phosphite ester of pentaerythritol, and (c) at least one compound selected from the group consisting of phosphate monoesters, phosphate diesters and phosphonates.

2. A lubricating composition according to claim 1, wherein the proportion of the component (a) is 98 to 40% by weight and the proportion of a total of the components (b) and (c) is 2 to 60% by weight, the ratio of the components (c)/(b) being 5/95 to 95/5.

3. A lubricating composition according to claim 1, wherein the phosphite ester of pentaerythritol is represented by the formula:

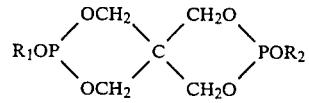

(I)

wherein $R_1$ is an alkyl group, or an alkylphenyl group; and $R_2$ is an alkyl group, an alkylphenyl group or hydrogen.

4. A lubricating composition according to claim 1, wherein the phosphate monoester is represented by the formula:

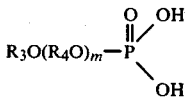

(II)

or

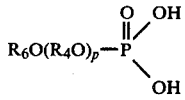

(IV)

wherein $R_3$ is an alkyl group; $R_6$ is an alkylphenyl group; $R_4O$ is an ethylene oxide group, a propylene oxide group, or a butylene oxide group; and m and p are independently an integer of 2 to 15, and the phosphate diester is represented by the formula:

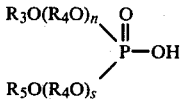

(III)

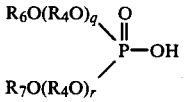

(V)

wherein $R_3$ and $R_5$ are independently an alkyl group; $R_4O$ is an ethylene oxide group, a propylene oxide group, or a butylene oxide group; $R_6$ and $R_7$ are independently an alkylphenyl group; n, s, q and r are independently an integer and $(n+s)/2$ being 2 to 15 and $(q+r)/2$ being 2 to 15.

5. A lubricating composition according to claim 1, wherein the phosphonate is represented by the formula:

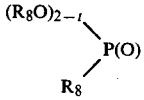

(VI)

wherein $R_8$ is an alkyl group; and t is zero or an integer of 1.

6. A lubricating composition according to claim 1, wherein the proportion of the component (a) is 95 to 40% by weight, the proportion of the component (b) is 2 to 25% by weight, and the proportion of the component (c) is 3 to 35% by weight.

7. A process for plastic forming a metallic workpiece which comprises coating the lubricating composition of claim 1 on a surface of a metallic workpiece, and conducting plastic forming of the metallic workpiece in the presence of a film formed by the lubricating composition.

8. A process according to claim 7, wherein the metallic workpiece is made of aluminum or aluminum alloy.

9. A metallic workpiece coated with the lubricating composition of claim 1.

10. A metallic workpiece according to claim 9, wherein the metallic workpiece is made of aluminum or aluminum alloy.

11. A lubricating composition suitable for metal forming comprising (a) a lubricating oil, (b) at least one phosphite ester of pentaerythritol represented by the formula:

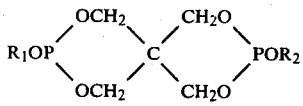

(I)

wherein $R_1$ and $R_2$ are independently an alkyl group or an alkylphenyl group, and (c) at least one phosphonate represented by the formula:

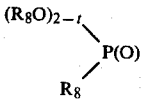

(VI)

wherein $R_8$ is an alkyl group; and t is zero or an integer of 1.

12. A lubricating composition according to claim 11, wherein the proportion of the component (a) is 95 to 40% by weight, the proportion of the component (b) is 2 to 25% by weight, and the proportion of the component (c) is 3 to 35% by weight.

13. A lubricating composition according to claim 11, wherein the lubricating oil is a mineral oil or a synthetic oil.

14. A lubricating composition according to claim 11, wherein the alkyl group in the definitions of $R_1$ and $R_2$ in the formula (I) is an octyl group, an isodecyl group, a lauryl group, a tridecyl group, a palmityl group or a stearyl group; and the alkylphenyl group in the definitions of $R_1$ and $R_2$ in the formula (I) is a nonylphenyl group or an octylphenyl group.

15. A lubricating composition according to claim 11, wherein the alkyl group in the definition of $R_8$ in the formula (VI) is a butyl group or an octyl group.

16. A lubricating composition suitable for metal forming comprising (a) a lubricating oil, (b) at least one phosphite ester of pentaery thritol represented by the formula:

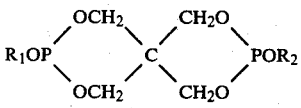

(I)

wherein $R_1$ is an alkyl group or an alkylphenyl group; and $R_2$ is an alkyl group, an alkylphenyl group or hydrogen, and (c) at least one compound selected from the group consisting of phosphate monoesters and diesters represented by the formulae:

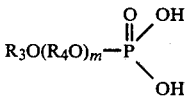

(II)

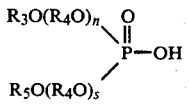

(III)

-continued

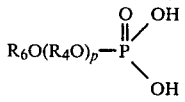

(IV)

and

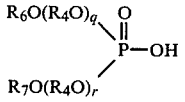

(V)

wherein $R_3$ and $R_5$ are independently an alkyl group; $R_4O$ is an ethylene oxide group, a propylene oxide group or a butylene oxide group; $R_6$ and $R_7$ are independently an alkylphenyl group; m and p are independently an integer of 2 to 15, and $(n+s)/2$ and $(q+r)/2$ are independently an integer of 2 to 15.

17. A lubricating composition according to claim 16, wherein the proportion of the component (a) is 98 to 40% by weight and the proportion of a total of the components (b) and (c) is 2 to 60% by weight, the ratio of the components (c)/(b) being 5/95 to 95/5.

18. A lubricating composition according to claim 16, wherein the component (a) is a mineral oil or a synthetic oil.

19. A lubricating composition according to claim 16, wherein the alkyl group in the definition of $R_1$ and $R_2$ in the formula (I) is an octyl group, an isodecyl group or a lauryl group, and the alkylphenyl group in the definition of $R_1$ and $R_2$ in the formula (I) is a nonylphenyl group or an octylphenyl group.

20. A lubricating composition according to claim 16, wherein the alkyl group in the definitions of $R_3$ and $R_5$ in the formulae (II) and (III) is an octyl group, an isodecyl group, a lauryl group, a tridecyl group, a palmityl group, a stearyl group or an oleyl group, and the alkylphenyl group in the definitions of $R_6$ and $R_7$ in the formulae (IV) and (V) is a nonylphenyl group or an octylphenyl group.

21. A process for plastic forming a metallic workpiece which comprises coating the lubricating composition of claim 11 on a surface of a metallic workpiece, and conducting plastic forming of the metallic workpiece in the presence of a film formed by the lubricating composition.

22. A process for plastic forming a metallic workpiece which comprises coating the lubricating composition of claim 16 on a surface of a metallic workpiece, and conducting plastic forming of the metallic workpiece in the presence of a film formed by the lubricating composition.

23. A metallic workpiece coated with the lubricating composition of claim 11.

24. A metallic workpiece coated with the lubricating composition of claim 16,

* * * * *